US007048567B2

(12) United States Patent
Regnier et al.

(10) Patent No.: US 7,048,567 B2
(45) Date of Patent: May 23, 2006

(54) EDGE CARD CONNECTOR ASSEMBLY WITH TUNED IMPEDANCE TERMINALS

(75) Inventors: Kent E. Regnier, Lombard, IL (US); Emanuel G. Banakis, Naperville, IL (US); Patrick R. Casher, North Aurora, IL (US)

(73) Assignee: Molex Incorporated, Lisle, IL (US)

( * ) Notice: Subject to any disclaimer, the term of this patent is extended or adjusted under 35 U.S.C. 154(b) by 42 days.

(21) Appl. No.: 11/086,050

(22) Filed: Mar. 22, 2005

(65) Prior Publication Data

US 2005/0164533 A1 Jul. 28, 2005

Related U.S. Application Data

(63) Continuation of application No. 10/434,710, filed on May 9, 2003, and a continuation of application No. 10/435,700, filed on May 6, 2003, now Pat. No. 6,863,543.

(60) Provisional application No. 60/379,950, filed on May 10, 2002.

(51) Int. Cl.
*H01R 13/62* (2006.01)

(52) U.S. Cl. ..... 439/329; 439/733.1; 439/495

(58) Field of Classification Search ..... 439/329, 439/608, 733.1, 495
See application file for complete search history.

(56) References Cited

U.S. PATENT DOCUMENTS

| | | | | |
|---|---|---|---|---|
| 5,102,346 | A | 4/1992 | Soes | |
| 5,309,630 | A | 5/1994 | Brunker et al. | |
| 5,915,979 | A | 6/1999 | Schell et al. | |
| 5,993,259 | A | 11/1999 | Stokoe et al. | |
| 6,095,821 | A * | 8/2000 | Panella et al. | 439/60 |
| 6,095,827 | A | 8/2000 | Dutkowsky et al. | |
| 6,254,435 | B1 * | 7/2001 | Cheong et al. | 439/637 |
| 6,299,483 | B1 | 10/2001 | Cohen et al. | |
| 6,394,823 | B1 | 5/2002 | Dunham et al. | |
| 6,776,659 | B1 * | 8/2004 | Stokoe et al. | 439/608 |
| 2004/0142606 | A1 | 7/2004 | Fogg | |

FOREIGN PATENT DOCUMENTS

| | | |
|---|---|---|
| EP | 0356156 A | 2/1988 |
| EP | 0651470 A | 5/1995 |

OTHER PUBLICATIONS

International Search Report for International Application No. PCT/US03/14410 mailed on Jul. 11, 2003.

* cited by examiner

*Primary Examiner*—Gary Paumen
(74) *Attorney, Agent, or Firm*—Thomas D. Paulius

(57) ABSTRACT

A surface mount connector has a dielectric housing with first and second opposing mating faces. The first mating face includes first terminals and the second mating face includes second terminals. The first and second terminals each have a tail portion, a contact portion and a terminal retention portion. The terminal retention portion engages the connector housing, and an opening, or hole, is formed in the retention section of the terminal. This opening is sized to keep sufficient metal remaining to retain the terminal in the housing, yet having sufficient surface area to provide a desired capacitance and/or inductance for tuning the impedance of the terminal to the preselected level, the second terminals each having a second terminal retention section with a central portion removed thereof, the removed central portion being spaced away from the first terminal retention area, while minimizing the surface area, size and shape of the central section for tuning the impedance of the terminal to a preselected range.

22 Claims, 5 Drawing Sheets

EDGE CARD CONNECTOR ASSEMBLY WITH TUNED IMPEDANCE TERMINALS

REFERENCE TO RELATED APPLICATIONS

This application is a continuation application of prior U.S. patent application, Ser. No. 10/434,710, filed May 9, 2003 and a continuation of application Ser. No. 10/435,700, filed May 6, 2003, now U.S. Pat. No. 6,863,543.

This application claims prior of U.S. Provisional patent application Ser. No. 60/379,950, filed May 10, 2002.

BACKGROUND OF THE INVENTION

The present invention is directed generally to edge card connectors and, more specifically to edge card connectors in which the connector impedance is controlled by shaping of the connector terminals.

High speed data transfer systems require electrical connectors in which the electrical impedance can be controlled in order to maintain the required data transfer rate of the electrical system. It is desirable at high speed data transfer rates to obtain a specific impedance in a connector that matches the impedance of the entire electronic system, i.e., the circuits on the a circuit board of an electronic device and either the circuits of opposing electronic device or in a transmission cable. The impedance of a connector may be controlled by the spacing of the terminals, the size of the terminals and the thickness and location of material within the connector housing.

However, low profile connectors, such as those used in SFP (Small Form Factor Pluggable) applications are desired in electronic devices in which space is a premium and thus it is difficult to control the impedance by modifying the spacing and size of the terminals in a reduced-size connector housing. When the terminals are modified, it becomes difficult to retain all of the mechanical functions of the connector, such as terminal retention and engagement while tuning the impedance of the connector.

The present invention is directed to an improved electrical connector system that combines the aforementioned characteristics.

SUMMARY OF THE INVENTION

Accordingly, it is a general object of the present invention to provide a low profile connector in which the terminals may have varying shapes for controlling the impedance of the connector.

Another object of the present invention to provide a surface mount style connector for mounting on a circuit board, the connector having a plurality of conductive terminals supported therein in spaced apart order, the terminals having stubs and slots formed as part thereof, thereby reducing and/or increasing the amount of metal to influence the capacitance and/or the inductance of the terminals and control the impedance thereof.

A further object of the present invention is to provide a right angle, low profile surface mount connector for use in high speed applications in which the connectors have a specific structure for controlling the impedance and inductance of electrical connectors.

A still further object of the present invention is to provide a connector for surface mounting to a printed circuit board, wherein the connector includes a dielectric housing having first and second opposing mating faces, the first mating face including a plurality of first stamped terminals, the second mating face including a plurality of second stamped terminals the terminals of a first type that are stamped from a metal strip and are inserted into slots in the housing from a front face, and terminals of a second type which are stamped from a second metal strip and are inserted into slots in the housing from a rear face, such that the first and second terminals are offset from each other and wherein the front and rear faces are substantially perpendicular to the printed circuit board onto which the assembly is mounted.

Another object of the present invention is to provide a connector assembly with the aforementioned terminal arrangement, wherein each of the second terminals include a first terminal retention section having a portion removed from the central portion thereof, the first terminal retention section having sufficient metal remaining to retain the terminal in the housing, yet having sufficient surface area to provide a desired capacitance for tuning the impedance of the terminal to the preselected level, the second terminals each having a second terminal retention section with a central portion removed thereof, the removed central portion being spaced away from the first terminal retention area, while minimizing the surface area, size and shape of the central section for tuning the impedance of the terminal to a preselected range.

A further object of this invention is to provide a connector assembly with the aforementioned terminal arrangement and shape, and with a second terminal with a solder section that is used to mount the connector to a printed circuit board, of a size and shape that is used to minimize metal area and the size and shape of the solder portion being used to tune the impedance of the terminal to the specified amount.

The present invention accomplishes the aforementioned and other objects by the way of its novel and unique structure.

In one embodiment of the invention, a connector assembly is provided for mounting to a circuit board with surface mount technology. The connector includes a dielectric housing and terminals of a first type which are stamped from a metal strip and are inserted into slots in a front face of the connector housing. Terminals of a second type are stamped from a second metal strip and are inserted into slots along the rear face of the connector housing so the first and second type terminals are opposing each other. The first and second sets of terminals are inserted into the connector housing along two distinct faces of the housing, which are preferably on opposite ends of the housing.

The first and second type terminals have cantilevered contact arm portions that extend into an internal receptacle of the connector housing which is designed to receive the edge of a circuit card. At least the second type terminals have contact portions, tail portions and intervening body portions. Part of the second type terminal body portions include terminal retention portions that are press fit into slots formed in the connector housing. At least one of these terminal retention portions has an opening formed therein, which has the practical effect of reducing the surface area of the metal, which affects the capacitance and inductance of the terminal (i.e., lowering the capacitance and increasing the inductance), thereby also influencing the impedance of the connector insofar as adjoining terminals are concerned and the openings are preferably used to tune the impedance of the terminal to a desired level. In order to compensate for the removal of metal in this portion of the terminal, the connector housing is modified to provide additional reaction surfaces that abut the terminal retention portion.

In another embodiment of the invention, the terminals have two terminal retention portions, each of which has an opening formed therein for impedance tuning. In one retention portion, the opening is disposed in a central part of the retention portion and preferably takes the form of a circular opening, while in the other retention portion, the opening takes the form of a slot extending along a central part thereof.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Figure 1:
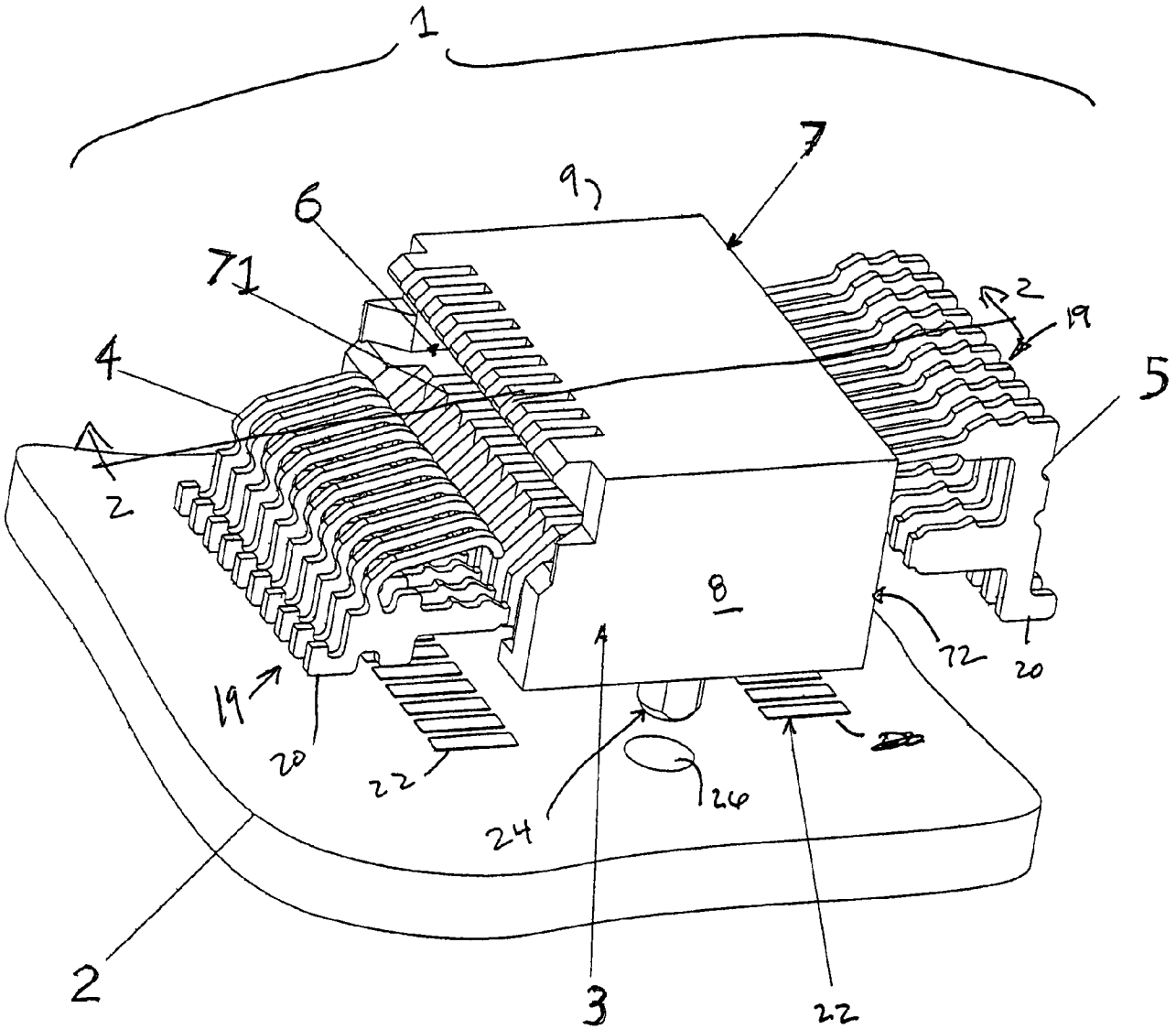
FIG. 1 (PRIOR ART)
FIG. 1 is an exploded perspective view of a known connector assembly illustrating one type of circuit board application to which the present invention is directed.

FIG. 1 illustrates a known connector assembly, generally designated as 1, that will be used to explain the environment in which the present invention operates. The connector assembly 1 is a surface-mount style and is intended for mounting to a printed circuit board 2. The connector assembly includes an insulative housing 3, preferably formed from a dielectric material, and a plurality of conductive terminals 19 are supported in the housing 3. The terminals 19 are arranged in two distinct sets of first terminals 4 and second terminals 5. The connector housing preferably has a configuration which includes a plurality of distinct faces and these faces include a first, or front face 6 and an opposing second, or rear face, 7. Side faces or sidewalls 8, 9 are seen to interconnect the front and rear faces 6, 7 of the housing together, and in the embodiment illustrated, the housing. The first face 6 of the connector housing may be considered as a mating face of the connector inasmuch as it contains a slot formed therein for receiving an edge of a circuit board or edge card therein, and the second face 7 of the connector housing may be considered as a mounting face inasmuch as a portion of the connector, by way of the rear terminals, is mounted to the circuit board 2.

The first terminals 4 are mounted into slots 71 formed in the connector housing 3 along its front face 6, while the second terminals 5 are mounted in slots 72 that are formed in the connector housing 3 along its rear face 7. The front and rear faces 6, 7 are oriented substantially perpendicular to the printed circuit board 2 onto which the connector housing 3 is mounted. Mounting portions 20 formed in the terminals 19 are located on the terminals 19 in locations spaced away from the connector housing 3 and serve as a means for connecting the terminals of the connector to corresponding conductive pads 22 formed with the circuit board 2 in a surface mount manner. These mounting portions are illustrated as conventional surface mount tails. The connector housing 3 may also include mounting pegs, or posts 24 formed therewith that are received within complementary openings 26 formed with the circuit board 2. This Figure depicts the connector environment in which terminals and connectors of the present invention are used.

Figure 2:
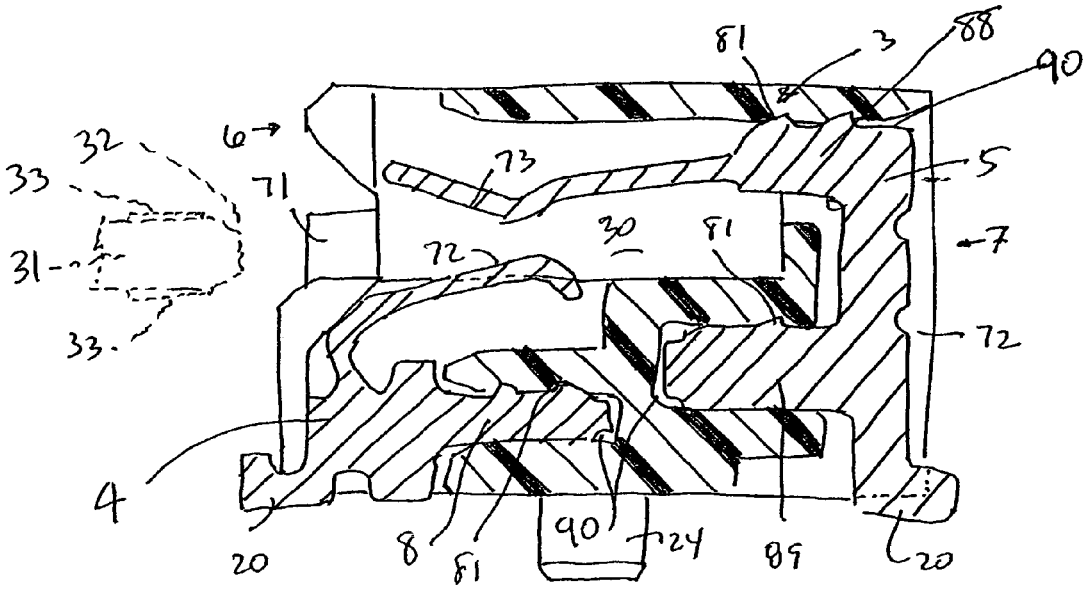
FIG. 2 (PRIOR ART)
FIG. 2 is a cross-sectional view of the connector assembly of FIG. 1 taken along line 2—2 thereof, removed from the circuit board and illustrating the housing, its mating slot and the positioning of first and second terminals therein.

FIG. 2 illustrates, in cross-section, the connector housing 3 of FIG. 1. This view shows the position of the two sets of terminals 4, 5. The connector housing 3 includes an internal cavity, or receptacle 30, which receives an insertion edge 32 of an edge card 31, illustrated in phantom. The two terminals 4, 5 each have contact arm portions 72, 73 that extend in a cantilevered fashion, from body portions 87, 88, into the internal receptacle 30 along opposite sides thereof in opposition to circuit pads 33 arranged on the circuit card 31. The terminals 4, 5 may also include terminal retention portions 8, 88 & 89 which may or may not form part of the terminal body portions. These retention portions include one or more teeth or barbs, 81, that skive, or cut, into the connector housing material along the edges of the three retention slots 90 which are shown in the Figure.

Figure 4:
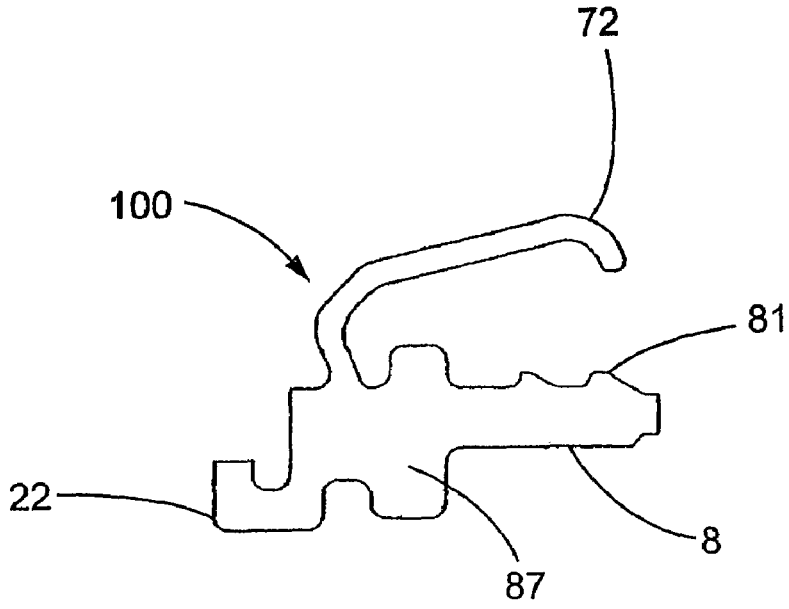
FIG. 4 is a side elevational view of a first type terminal utilized in the connector assembly of FIG. 1 and in the connectors of the present invention.

FIG. 4 illustrates, a first type of terminal 100 that is use din the connectors of the invention. This terminal 100 is seen to have a surface mount portion 22, an elongated, cantilevered contact portion 72 that extends into a card-receiving slot of the connector, a body portion 87, and a terminal retention portion 8 that is received within a slot or cavity formed in the connector housing. Barbs 81 are provided as part of the terminal retention portion 8 to increase the retention of the terminal in the connector housing.

Figure 5:
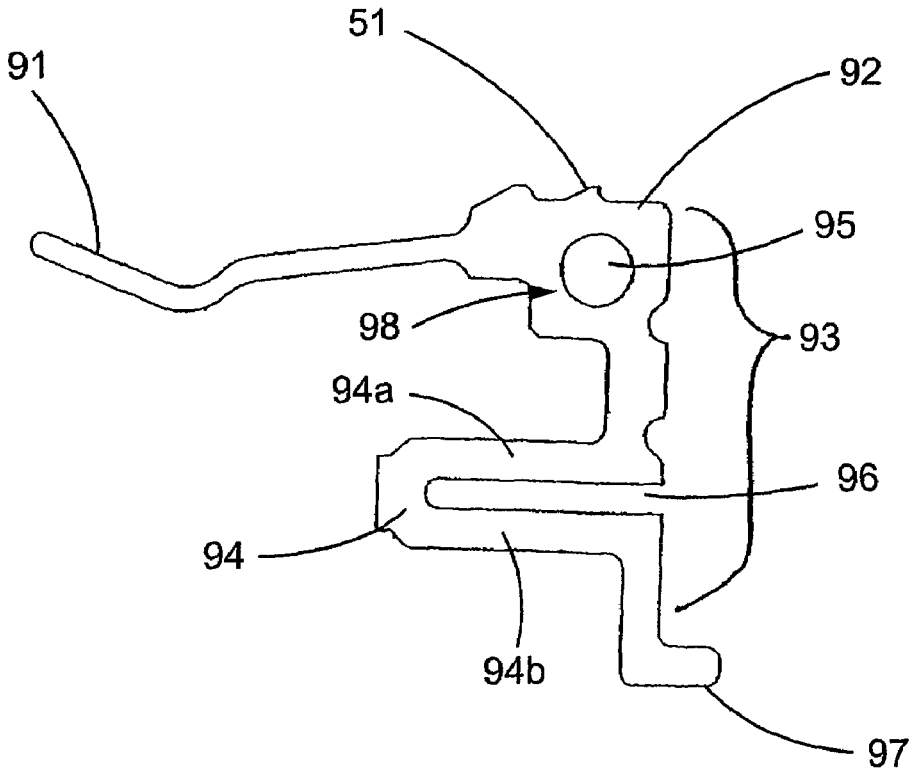
FIG. 5 is a side elevational view of a second type terminal utilized in connectors of the present invention in which the body portions thereof have been modified to reduce the overall surface area of metal in the body portion and to improve retention of the terminal within the connector housing of FIG. 3.

FIG. 5 illustrates a terminal 101 used in the second set (or type) of terminals in connectors of the present invention. The terminal 101 includes an elongated, cantilevered contact portion 91, a first (upper) retention section 92 that is also considered to be part of a terminal body portion 93. A second (lower) retention section 94 is also provided and is spaced apart from the first retention section 92. Both retention sections 92, 94 are disposed on the terminal 101 between the contact portion 91 and the mounting, or tail portion, 97.

The first retention portion 92 includes a relatively large central part 98, which has an opening 95 formed therein. This opening is shown as circular and completely enclosed within the terminal retention area and serves to reduce the metal of the terminal and this particular portion thereof and it also reduces the capacitance of the terminal with respect to any adjoining terminal, by reducing the amount of surface area of the terminal. This reduction of material also increases the inductance of the terminal, which also influences the impedance of the terminal. The reduction of capacitance (or increase in inductance) will in turn, as is known, affect the impedance of the terminal, and of the connector overall in the region from the second terminal contact portion 91 to the mounting portion 97 thereof. In the illustrated embodiment, the opening 95 is shown as circular, a variety of other shapes, preferably polygon shapes may be used. The size and shape of this first retention portion 92 may be varied in order to vary the impedance of the system. The second terminal retention portion 94 also has an opening 96 formed therein and this opening 96 takes the form of a slot that preferably extends from an edge and through a portion of the central area of the second terminal retention portion 94. This slot 96 is not completely enclosed in the retention portion 94 as in the top retention portion. In the illustrated embodiment, the open sided slot 96 is defined by parallel legs 94*a*, 94*b* of the terminal retention portion 94 that are interconnected at one end and which define a continuous uninterrupted directional signal transmission path between the contact and mounting portions 91, 94 via the interconnected legs 94*a*, 94*b* of the retention portion.

Figure 6:
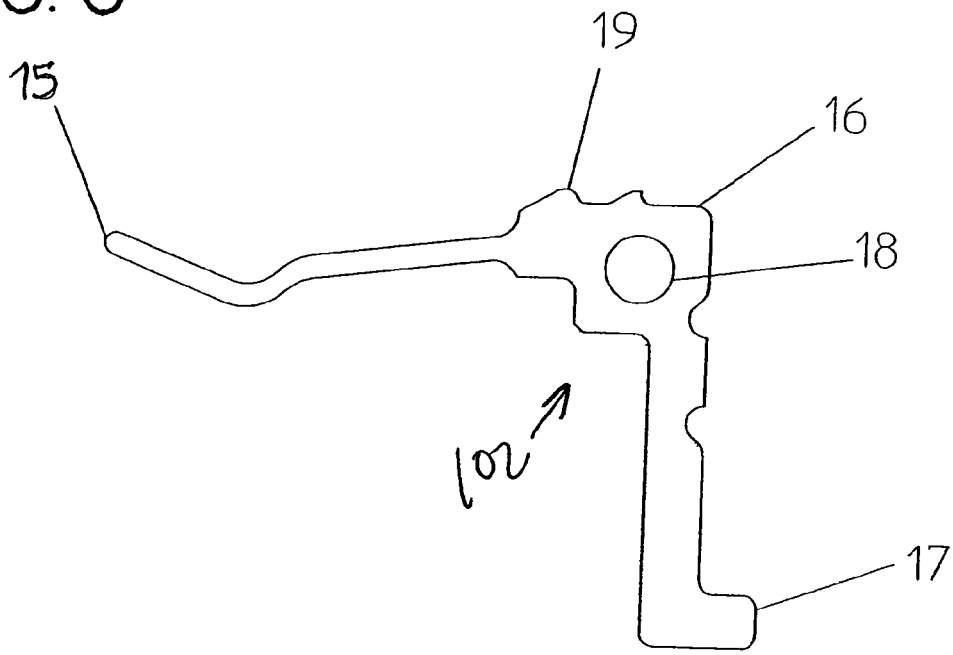
FIG. 6 is a side elevational view of another embodiment of a second type terminal suitable for use in connectors of the present invention illustrating another modification of only a single terminal body portion to reduce the overall surface area thereof.

FIG. 6 illustrates another embodiment of a second terminal, where the terminal 102 contains a contact section 15, a single retention section 16, and a board mounting section 17. The retention section 16 of this second terminal 102 also contains an opening 18 therein in which metal has been removed from the stamped terminal 102. In the illustrated embodiment, this central portion is substantially circular, but can also take a variety of shapes. The size and shape of this central portion can be varied in order to vary the impedance of the system. The retention section of the second terminal may contain barbs 19 which are used to embed in the slots of the dielectric housing to provide terminal retention. The size of the board mounting portion 17 may also be varied to provide adequate area for mounting to the printed circuit board, while also being tuned to provide a specific impedance in the terminal.

Figure 3:
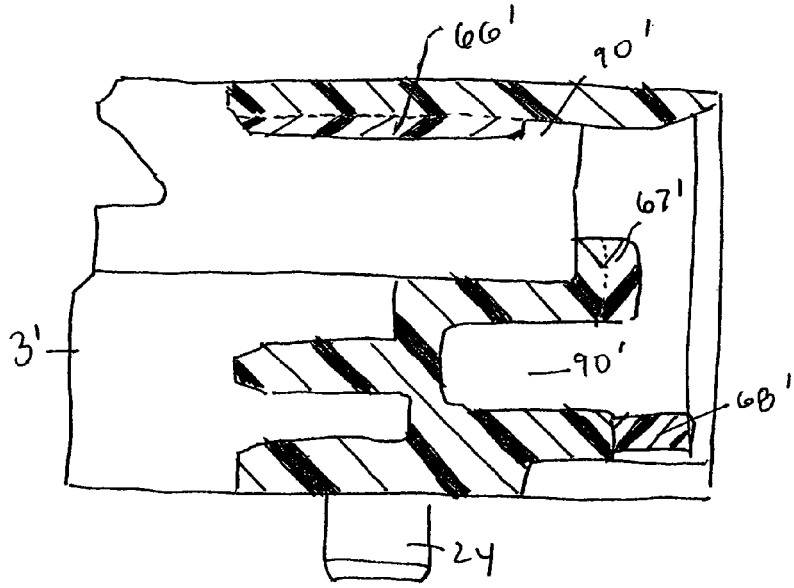
FIG. 3 is a cross-sectional view of a connector housing constructed in accordance with the principles of the present invention.
Figure 8:
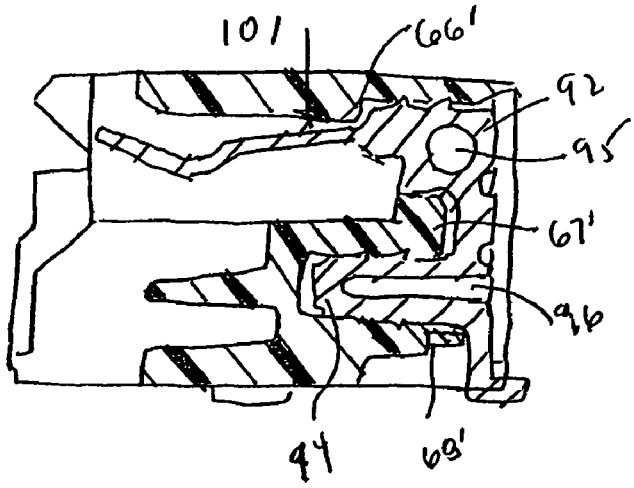
FIG. 8 is a cross-sectional view of the connector housing of FIG. 3, with a second terminal as shown in FIG. 6, inserted in place within the rear face of the housing; and, FIG. 9 is a cross-sectional view of the connector housing of FIG. 3, with a first terminal as shown in FIG. 4 and a second terminal as shown in FIG. 5 inserted therein.
Figure 9:
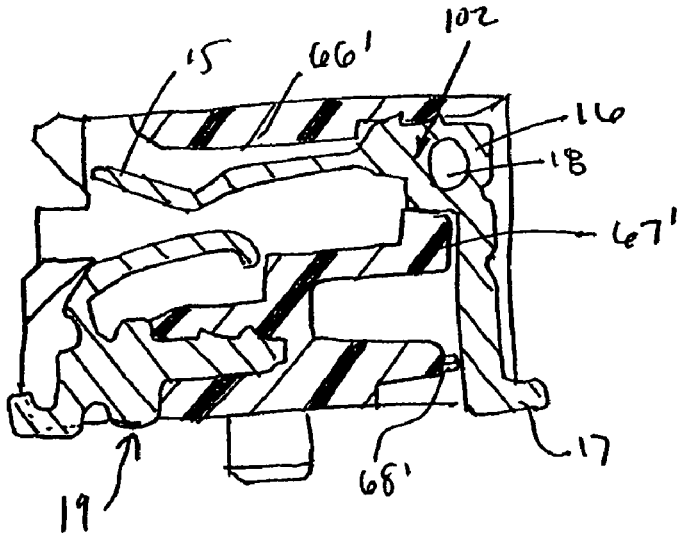

The terminals are easily stamped from sheet metal, but because of the openings 95, 96 formed thereon, a concern is raised about the ability to retain the second terminals 101, 102 within the connector housing 3. This concern is alleviated by modifying the connector housing 3', as illustrated in FIG. 3, in order to provide additional housing material 66', 67' and 68' near the retention slots 90'. The effect of this additional material is shown in FIGS. 8 & 9, where the material 66' and 67' enclose and abut the enlarged terminal first retention portion 92 and in effect, provide additional reaction surfaces against which the retention portions 92, 94 bear. FIG. 9 illustrates how the other second terminal of FIG. 3 is fit into the housings 3' of the invention.

The length and width of the second retention portion can also be varied in order to vary the surface area of the terminal, and therefore also the impedance. Both first and second retention sections of the second terminal may contain barbs, or teeth 51 which are used to embed the terminals 101 firmly and reliably within the slots 72 of the connector housing 3. The size of the board mounting section may also be varied to provide adequate area for mounting to the printed circuit board, while also being tuned to provide a specific impedance in the terminal.

Figure 7:
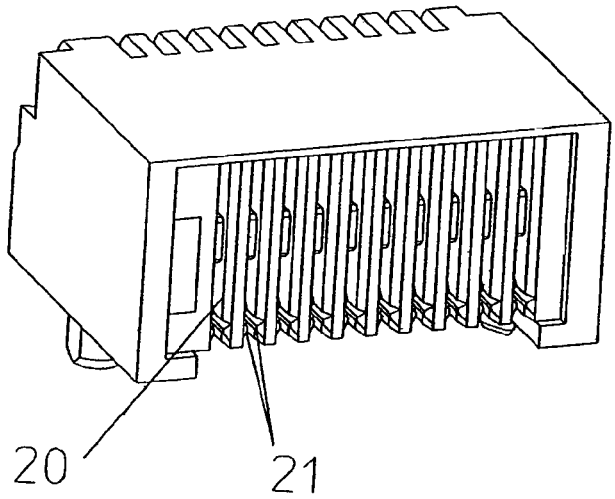
FIG. 7 is a perspective view of the connector housing of FIG. 3, angled to show the rear face thereof and having the second terminals of FIG. 5 inserted therein.

FIG. 7 illustrates the rear face of the connector housing, where each of the terminal receiving slots 72 include a pair of opposing retention bumps 21 disposed on opposite sides of the terminal, for increased terminal retention to the housing.

While the preferred embodiment of the invention have been shown and described, it will be apparent to those skilled in the art that changes and modifications may be made therein without departing from the spirit of the invention, the scope of which is defined by the appended claims.

What is claimed is:

1. A connector for providing a connection between a circuit board and an opposing electronic element, the circuit board having a plurality of conductive traces disposed thereon and the opposing electronic element including a male portion having a plurality of conductive members disposed thereon, comprising:

an insulative connector housing having first and second ends, the connector housing first end being a front end including a receptacle portion for mating with said opposing electronic element and the connector housing second end being a rear end;

a plurality of conductive terminals supported by said housing, the terminals being arranged in distinct sets of first and second terminals, the first and second terminals including contact portions for contacting a corresponding conductive member of said opposing electronic element, mountings portion for mounting said terminal to a circuit board, body portions interconnecting the mounting portions together, and retention portions for retaining the terminal in place with the connector housing, the terminal retention portions being disposed intermediate said terminal contact and terminal mounting portions, the first set of terminals being inserted into said connector housing from said front end thereof and the second set of terminals being inserted into said connector housing from said rear end;

said retention portions of the second terminals each having open sided impedance control openings extending into the retention portion from a rear side thereof, and said terminal retention portions and being sized so as not to weaken the retention of said second terminals within said connector housing by said terminal retention portions.

2. The connector as claimed in claim 1, wherein said connector housing includes a plurality of first and second cavities respectively disposed along said front and rear ends, each of the first cavities receiving a single first terminal therein and each of the second cavities receiving a single second terminal therein.

3. The connector as claimed in claim 1, wherein said second terminal retention portion openings are open sided slots that extend forwardly into the retention portions from rear sides of the second terminals.

4. The connector as claimed in claim 3, wherein said slots extend into the retention portions in substantially parallel relation to the contact portions.

5. A surface mount connector for providing a connection between a circuit board and an opposing electronic element, the circuit board having a plurality of conductive traces disposed thereon and the opposing electronic element including a male portion having a plurality of conductive portions disposed thereon, comprising:

an insulative connector housing having front and rear ends, the connector housing, front end including a receptacle portion for receiving the opposing electronic element male portion;

a plurality of conductive terminals arranged in said housing, the terminals being arranged in distinct sets of first and second terminals, the first terminals being disposed within said connector housing along said front end, said first terminals including contact portions for contacting corresponding conductive portions of said opposing electronic element male portion, and tail portions for mounting said first terminals to first conductive traces on said circuit board;

the second terminals being disposed within said connector housing along said rear end, the second terminals including contact portions for contacting corresponding conductive portions of said opposing electronic element male portion, tail portions for mounting said second terminals to second conductive traces on said circuit board and retention portions for retaining the terminal in place with the connector housing, the terminal retention portions being disposed between said second terminal contact and tail portions, said second terminal retention portions having open sided impedance control openings extending into the retention portion from a rear side thereof, and said second terminal retention portions being of sufficient size so as not to weaken the retention of said second terminals within said connector housing by said second terminal retention portions.

6. The surface mount connector of claim 5, wherein said second terminal are stamped and formed from a metal.

7. The surface mount connector of claim 5, wherein said connector housing rear end includes a plurality of slots, and said second terminal retention portions are received within said the connector housing rear end slots.

8. The surface mount connector of claim 5, wherein said second terminal retention portion openings are elongated slots that extend forwardly into the retention portion.

9. The surface mount connector of claim 8, wherein said second terminal retention portion slots extend in the same direction as said second terminal contact portions.

10. The surface mount connector of claim 5, wherein said second terminal retention portions include barbs for engaging said connector housing.

11. The surface mount connector of claim 5, wherein said second terminal retention portions are disposed within said connector housing at a level beneath said first terminal contact portions.

12. A connector, comprising:

an insulative connector housing having front and rear ends, the connector housing front end including a receptacle portion for receiving a mating portion of an opposing electronic element;

a plurality of conductive terminals arranged in distinct sets of first and second terminals, the first terminals being disposed within said connector housing along said front end, said first terminals including contact portions extending into the connector housing receptacle portion, and mounting portions extending out from said connector housing for surface mounting to a circuit board;

the second terminals being disposed within said connector housing along said rear end, the second terminals including contact portions extending into said connector housing receptacle portion, mounting portions extending out from said connector housing for surface mounting to the circuit board and retention portions for retaining the terminal in place with the connector housing, the terminal retention portions being disposed between said second terminal contact and mounting portions, and said second terminal retention portions having open sided slots formed therein extending into the retention portion in the same direction as said second terminal contact portions.

13. The connector of claim 12, wherein said second terminal contact portion and said retention portion have a general S-shaped configuration.

14. The connector of claim 12, wherein said second terminal retention portion is disposed between said second terminal contact and surface mount portions.

15. The connector of claim 12, wherein said second terminal retention portions include barbs for engaging said connector housing.

16. The connector of claim 12, wherein said second terminal retention portions extends into said connector housing at a level below both of said first and second terminal contact portions.

17. The connector of claim 12, wherein said first and second terminal surface mounting portions extends in opposite directions respectively from said connector housing front and rear ends.

18. The connector of claim 8 in which said elongated slots extend forwardly into said second terminal retention portions in substantially parallel relation to the contact portions of the second terminals.

19. A connector for providing a connection between a circuit board and an opposing electronic element, the circuit board having a plurality of conductive traces disposed thereon and the opposing electronic element including a male portion having a plurality of conductive members disposed thereon, comprising:

an insulative connector housing including a receptacle portion for mating with said opposing electronic element, a plurality of conductive terminals supported by said housing, said terminals being arranged in distinct sets of first and second terminals, the first and second terminals each including a contact portion for contacting a corresponding conductive member of an opposing electronic element, a mounting portion for mounting said terminal to a circuit board, and a retention portion for retaining the terminal in place in the connector housing, said first terminals being inserted into said connector housing from one side thereof and said second set of terminals being inserted into said connector housing from a second side thereof, said retention portions of the second terminals each having an elongated open sided opening defined by first and second legs of the retention portion, said first and second retention portion legs each having first and second ends, said first ends of said retention portion legs being electrically interconnected, said first and second retention portion legs and the second ends thereof having a space therebetween that opens to one side of the terminal, and said second end of said first leg being electrically connected to said contact portion and said second end of said second leg being electrically connected to said mounting portion for defining a continuous, uninterrupted directional signal transmission path between said contact and mounting portions via one of the legs of said retention portion, the interconnection between the first ends of said retention portion legs, and then the other leg of the retention portion.

20. The connector of claim 19 in which said first and second retention portion legs are disposed in parallel relation to each other.

21. The terminal of claim 19 in said first and second retention portion legs define an elongated slot opening to a side of the terminal.

22. The terminal of claim 21 in which said first and second retention portion legs and said elongated slot extend from a side of the second terminal in the same direction as said contact portion.

* * * * *

UNITED STATES PATENT AND TRADEMARK OFFICE

CERTIFICATE OF CORRECTION

PATENT NO. : 7,048,567 B2
APPLICATION NO. : 11/086050
DATED : May 23, 2006
INVENTOR(S) : Regnier et al.

It is certified that error appears in the above-identified patent and that said Letters Patent is hereby corrected as shown below:

Title page Related U.S. Application Data Item [60] should read

Continuation of application No. 10/434,710, filed on May 9, 2003, now Pat. No. 7,025,617.

Signed and Sealed this

Ninth Day of June, 2009

JOHN DOLL
*Acting Director of the United States Patent and Trademark Office*